US009764492B2

(12) United States Patent
Djernæs

(10) Patent No.: US 9,764,492 B2
(45) Date of Patent: Sep. 19, 2017

(54) METHOD AND DEVICE FOR CONVEYING POLYMERIC OBLATES TO CASTING MACHINES AND APPLICATION

(71) Applicant: ESS Technology A/S, Pandrup (DK)

(72) Inventor: Søren Djernæs, Pandrup (DK)

(73) Assignee: RPC Superfos A/S, Taastrup (DK)

( * ) Notice: Subject to any disclaimer, the term of this patent is extended or adjusted under 35 U.S.C. 154(b) by 52 days.

(21) Appl. No.: 14/442,169

(22) PCT Filed: Aug. 28, 2013

(86) PCT No.: PCT/DK2013/000053
§ 371 (c)(1),
(2) Date: May 12, 2015

(87) PCT Pub. No.: WO2014/086359
PCT Pub. Date: Jun. 12, 2014

(65) Prior Publication Data

US 2016/0236370 A1 Aug. 18, 2016

(30) Foreign Application Priority Data

Dec. 7, 2012 (DK) ..... 2012 00775

(51) Int. Cl.
*B26D 7/18* (2006.01)
*B65H 35/10* (2006.01)
(Continued)

(52) U.S. Cl.
CPC ..... *B26D 7/1863* (2013.01); *B26D 7/025* (2013.01); *B26D 7/1836* (2013.01); *B26F 1/40* (2013.01); *B65H 16/00* (2013.01); *B65H 35/10* (2013.01)

(58) Field of Classification Search
CPC .... B26D 7/1863; B26D 7/1836; B26D 7/025; B26F 1/40; B65H 35/10; B65H 16/00; B29C 31/008
See application file for complete search history.

(56) References Cited

U.S. PATENT DOCUMENTS 4,466,787 A * 8/1984 Ragir ..... B29C 45/14024 264/247
4,728,477 A * 3/1988 Dromigny ..... B29C 45/14024 264/153

(Continued)

FOREIGN PATENT DOCUMENTS

BE 1008590 A3 * 6/1996 ..... B29C 45/14008
EP 0323097 12/1989

*Primary Examiner* — Robert B Davis

(57) ABSTRACT

The invention includes a method and device for conveying pre-printed polymer oblates (IML), supplied in a roller, to a casting machine such as an injection press that molds items such as cups or lids, where the oblates must be integrated in items by the oblates being partially punched such that they remain fixed to the roller in points or bridges, after which the roller with the semi-punched oblates is placed on a device (1) from which the roller with oblates is rolled out in stages, such that the oblates pass through a tool (5) with holes (9) which are shaped to fit the circumference of the oblates, after which the oblates are removed with a device such as a robot with vacuum suction that tears over the river bridges that fix the oblate to the roller and transfers the oblates to the injection casting tool.

14 Claims, 1 Drawing Sheet

(51) Int. Cl.

| | |
|---|---|
| ***B26F 1/40*** | (2006.01) |
| ***B26D 7/02*** | (2006.01) |
| *B65H 16/00* | (2006.01) |

(56) References Cited

U.S. PATENT DOCUMENTS 5,037,595 A * 8/1991 Kornelis ..... B29C 45/14024
264/153
5,112,427 A 5/1992 Bekker-Madsen
5,273,416 A * 12/1993 Heyn ..... B26F 1/3846
264/153

* cited by examiner

METHOD AND DEVICE FOR CONVEYING POLYMERIC OBLATES TO CASTING MACHINES AND APPLICATION

CROSS-REFERENCE TO RELATED APPLICATIONS

This application is a U.S. national state of International Appl. No. PCT/DK2013/000053 filed 28 Aug. 2013, which claimed priority to Danish Appl. No. PA 2012 00775 filed 7 Dec. 2012, which applications are incorporated herein by reference in their entireties.

TECHNICAL FIELD

The invention relates to a method for conveying of pre-printed polymer oblates, which are e.g. produced in a so-called flexo printing machine and supplied in a roller, to a casting machine such as an injection press that moulds items such as cups or lids, where the oblates will be integrated in the items.

Furthermore, the invention relates to an apparatus which is suitable for conveying rolled-up printed polymer oblates.

The invention furthermore relates to the use of the apparatus.

BACKGROUND

It is commonly known to incorporate pre-printed polymer oblates in items such as cups or lids with a view to give the items a trusted and qualitatively attractive exterior.

This technology is typically used for items such as cups and lids as food packaging where items are manufactured in an injection press in which the pre-printed oblate is conveyed to the injection press and thereby integrated into the workpiece when it is molded.

A pre-printed polymer oblate which is integrated into an item that is injection casted is often referred to as an Inmould Label abbreviated IML.

IML is a plastic film which is typically printed in a so-called flexo printing machine. After printing, a film is laminated onto the product in order to confine the pressure since the material, as mentioned earlier, is often used for packaging in the food industry.

The currently known technology and the method of handling the IML for the conveyance of the oblates to a molding machine such as an injection press typically comprise the following:

Following lamination, the product is punched with a contour that is matched to the application. After punching, the remaining grid is rolled-up or removed by suction. The individual products are supplied in layers on a conveyor. At this stage of production, the individual products are heavily charged with static electricity, which makes it impossible to assemble products in an acceptable stack for the injection press.

Static electricity occurs when the products are punched out of the web. A lot of effort is put into preventing this condition; for example by adding charged ions to the web before punching. However, this is not sufficient to prevent the static electricity.

From the supply conveyor, the products are stacked to the extent possible—and placed on pallets which are then stocked. After a couple of days, the static electricity is minimised, and the pallet is retrieved. It is now possible to create proper stacks that can be used for injection casting.

The IML stack is placed in a magazine. A handling robot collects an IML by means of vacuum and places it in the injection molding tool. Here, it is necessary to supply static electricity to the IML so that it can hook onto the tool until this is closed and ready for molding.

The print shop has striven to eliminate static electricity from IML, whereas static electricity must be supplied to the IML during the molding process to enable the IML to attach itself to the molding tool. The fact that the print shop has removed static electricity relatively efficiently, makes it hard to reload the IML.

Another method is to cut the web into sheets. This way, it is possible to create a stack; however, the air between the sheets must be pressed out before storage. In a so-called guillotine, the products are cut into squares. Each stack is pressed through a "sausage roller" into the final shape. This method is problematic, however, since the products tend to coalesce along the edge.

The currently known and most widely used technology has some drawbacks including the following:

It requires a lot of labour and resources to produce a stack of IML oblates

Cutting out the individual IML generates a relatively large amount of waste material It is difficult and costly to manage static electricity The initial investment in equipment for the production of IML is relatively large and often constitutes up to one million Euros.

SUMMARY OF THE INVENTION

It is therefore an object of the invention to provide a method for handling IML without the above-mentioned drawbacks and to provide an apparatus which is suitable for implementing the method.

The object of the invention is achieved by a method for conveying of at least one pre-printed polymer oblate (IML), produced in a flexo printing machine and supplied in a roller, to a casting machine configured to molds items, wherein the at least one oblate will be integrated into the items, including semi-punching the at least one oblate such that the at least one oblate remains attached to the roller by connection points or bridges, attaching the roller with the at least one semi-punched oblate to a device from which the roller with the at least one semi-punched oblate is rolled out in stages, such that the at least one semi-punched oblate passes through a tool with holes shaped to comply to the oblate form, and removing at least one of the semi-punched oblates with a robot that is configured to tear the connection points or bridges that hold the semi-punched oblates onto the roller and transfer the at least one oblate to the casting machine.

In this way, it becomes possible to use pre-printed polymer oblates (IML) without first having to cut them free and stack them, whereby production costs and the initially required investments are reduced by up to 90%.

As previously mentioned, the invention also relates to an apparatus.

The apparatus is characterized in comprising an unwinder for attaching a roller of oblates from which the rolled-up oblates are passed through a tool that contains holes which are shaped to fit the circumference of the oblates.

This makes it possible to convey oblates, including IML, directly from a roller to the tool where e.g. a robot can remove the individual oblates, without prior loosening and stacking, and transfer them to an injection press.

This achieves hitherto unattainable savings in equipment and production costs.

Several appropriate embodiments of the device are shown and described further below.

The invention relates, as mentioned before, to the use of the device for conveying the pre-printed, semi-punched polymer oblates from a roller to a robot that tears off the individual oblates from the roller and transfers them to an injection press, which moulds items such as cups or lids onto which the oblates are integrated during the injection press.

Using the specific application, the exemplary method of the present invention is efficiently implemented by the apparatus according to one or more of the exemplary embodiments of the present invention.

BRIEF DESCRIPTION OF THE DRAWINGS

The invention will now be explained more further with reference to the drawings, in which.

DETAILED DESCRIPTION OF THE INVENTION

Figure 1:
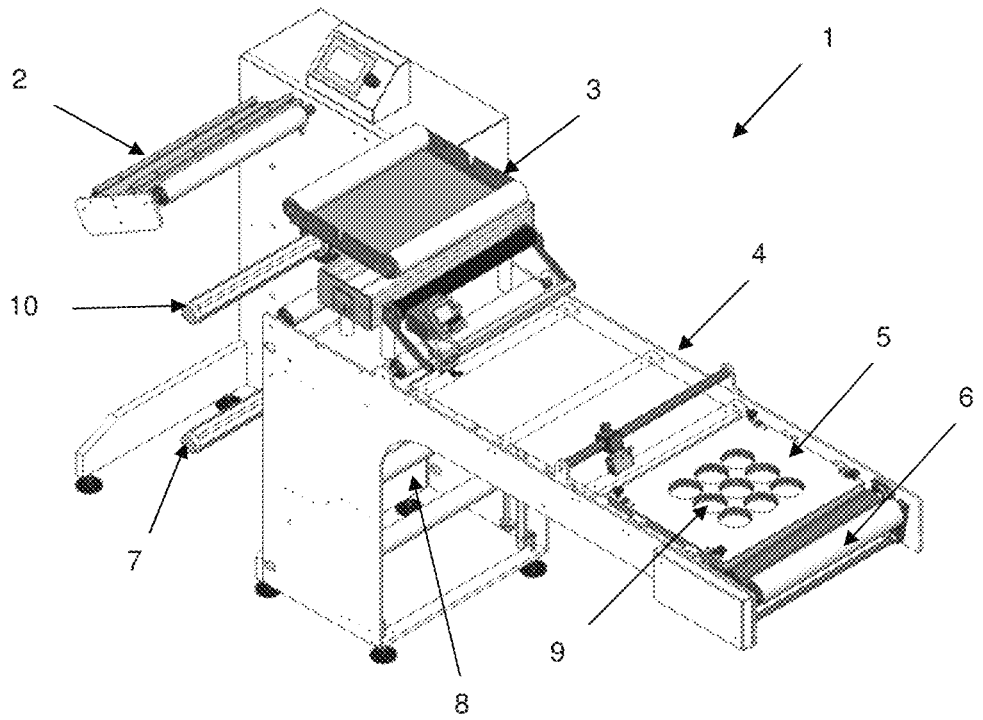
FIG. 1 shows a perspective view of an apparatus which is suitable for conveying rolled-up, pre-printed polymer oblates (IML)

FIG. 1 denotes, as 1 shows, an apparatus which is suitable for conveying rolled-up, pre-printed polymer oblates (IML), which are partially punched, as indicated, by a process which includes that the oblates are semi-punched so that they remain attached to the roller in the bridges, according to which the roller with the semi-punched oblates are placed in an apparatus 1 from which the roller with the oblates is rolled out in stages, feeding the oblates through a tool 5, which consists of an upper and lower part with holes 9 which are shaped to fit the circumference of the oblates, after which an oblate is removed with a unit such as a robot with vacuum suction that tears over the bridges that fix the oblates to the roller and transfers the oblates to the injection press.

In a preferred processing method, the tool 5 is prepared so that the upper part and the lower part with holes 9 are clamped around the film web with oblates for the fixation of the film before the tearing off of an oblate.

The apparatus 1 comprises an unwinder 10 for attaching a roller of oblates from which the rolled-up oblates are conveyed through a tool 5 that is formed with holes 9 which are shaped to fit the circumference of the oblates.

Figure 2:
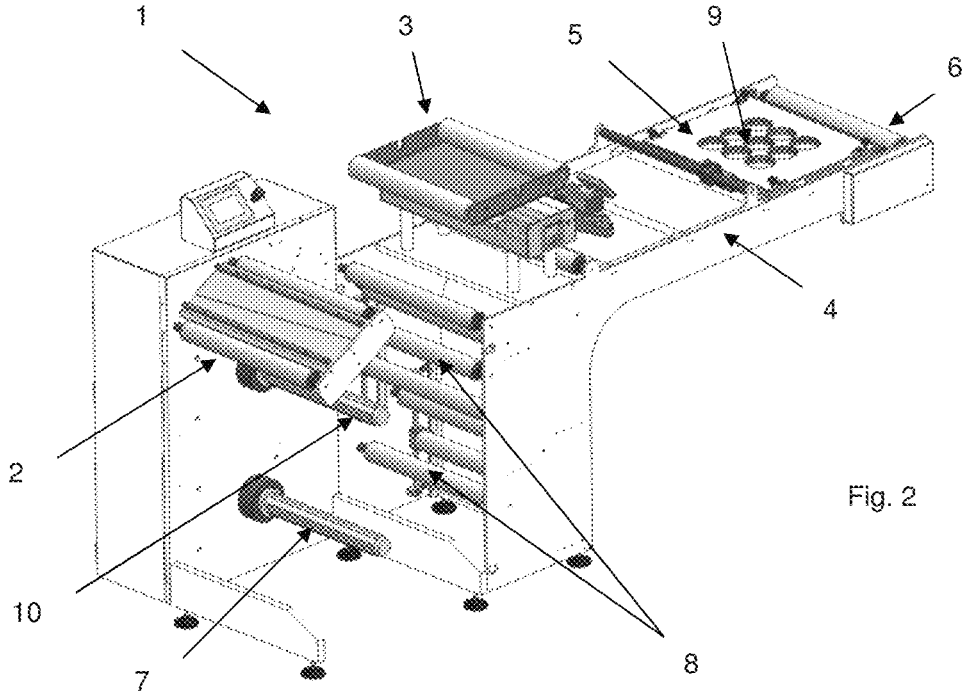
FIG. 2 shows, just as FIG. 1, the same apparatus which is suitable for conveying rolled-up, pre-printed polymer oblates (IML), but from a different angle.

In a preferred processing method as shown in FIG. 1 and FIG. 2, the apparatus is further characterized in a splice table 2 being positioned between the unwinder 10 and the tool 5, which the rolled-up oblates pass after the unwinder 10 from which the rolled-up oblates are conveyed past a so-called web guide 3, and then past a delivery board 4 that guides the rolled-up oblates for positioning through the tool 5.

As shown in FIG. 1 and FIG. 2, the apparatus 1 is also fitted with a feeder 6, which can advance the rolled-up oblates through the apparatus 1, where the feeder 6 is positioned after the tool 5.

The apparatus 1 also contains a buffer system 8 which comprises a plurality of spring-loaded rollers to compensate for pulling the rolled-up oblates.

The buffer system reduces the instantaneous characteristics of the rolled-up oblates when they are advanced by the feeder 6.

FIGS. 1 and 2 show that the apparatus 1 also comprises a winder 7 for rolling up roller residue after removal of oblates.

As stated, the invention comprises the use of said apparatus 1 for conveying pre-printed, semi-punched polymer oblates from a roller to a robot that tears off the individual oblates from the roller and transfers them to an injection press that moulds items such as cups or lids where the oblates are integrated into the injection press.

The invention claimed is:

1. A method for conveying of at least one pre-printed polymer oblate (IML), produced in a flexo printing machine and supplied in a roller, to a casting machine configured to molds items, wherein the at least one oblate will be integrated into the items, comprising:

semi-punching the at least one oblate such that the at least one oblate remains attached to the roller by connection points or bridges, attaching the roller with the at least one semi-punched oblate to a device from which the roller with the at least one semi-punched oblate is rolled out in stages, such that the at least one semi-punched oblate passes through a tool with holes shaped to comply to the oblate form, and removing at least one of the semi-punched oblates with a robot that is configured to tear the connection points or bridges that hold the semi-punched oblates onto the roller and transfer the at least one oblate to the casting machine.

2. A device that is suitable for conveying rolled-up, pre-printed polymer oblates, which are partially punched, comprising:

an unwinder for attaching a roller of oblates from which the rolled-up oblates are fed through a tool that contains holes which are shaped to fit the circumference of the oblates;

a splice-table positioned between the unwinder and the tool, wherein the rolled-up oblates pass the splice-table after the unwinder;

a web guide that the rolled-up oblates are conveyed past; and a delivery board configured to feed the rolled-up oblates for positioning through the tool.

3. The device according to claim 2, further comprising a feeder which can pull rolled oblates forward through the device, and wherein the feeder is placed after the tool.

4. The device according to claim 2, further comprising a buffer system that contains a number of rollers for equalization of traction in rolled-up oblates.

5. The device according to claim 2, further comprising a winder for rolling-up roller residue after removal of oblates.

6. The device according to claim 2, wherein the device is configured to convey pre-printed, semi-punched polymer oblates from the roller to a robot that tears off the individual oblates from the roller and transfers them to an injection moulding tool that moulds items onto which the oblates are integrated in the injection press.

7. The method according to claim 1, wherein the casting machine is an injection press that molds items.

8. The method according to claim 1, wherein the robot uses vacuum suction to tear over the connection points or bridges.

9. The device according to claim 6, wherein items molded by the injection moulding tool are cups or lids.

10. The method according to claim 7, wherein items molded by the injection press are cups or lids.

11. A device that is suitable for conveying rolled-up, pre-printed polymer oblates, which are partially punched, comprising:

an unwinder for attaching a roller of oblates from which the rolled-up oblates are fed through a tool that contains holes which are shaped to fit the circumference of the oblates; and a buffer system that contains a number of rollers for equalization of traction in rolled-up oblates.

12. The device according to claim 11, further comprising a feeder which can pull rolled oblates forward through the device, and wherein the feeder is placed after the tool.

13. The device according to claim 11, further comprising a winder for rolling-up roller residue after removal of oblates.

14. The device according to claim 11, wherein the device is configured to convey pre-printed, semi-punched polymer oblates from the roller to a robot that tears off the individual oblates from the roller and transfers them to an injection moulding tool that moulds items onto which the oblates are integrated in the injection press.

* * * * *